US011497674B2

(12) United States Patent
Cheng

(10) Patent No.: US 11,497,674 B2
(45) Date of Patent: Nov. 15, 2022

(54) PERCUSSIVE MASSAGE DEVICE HAVING A USB PORT

(71) Applicant: Guomei Cheng, Jiangsu (CN)

(72) Inventor: Guomei Cheng, Jiangsu (CN)

(73) Assignee: Nanjing Yunkai Machinery Co., Ltd, Nanjing (CN)

( * ) Notice: Subject to any disclaimer, the term of this patent is extended or adjusted under 35 U.S.C. 154(b) by 402 days.

(21) Appl. No.: 16/877,488

(22) Filed: May 19, 2020

(65) Prior Publication Data

US 2020/0276079 A1 Sep. 3, 2020

(51) Int. Cl.
*A61H 23/00* (2006.01)
*A61H 23/02* (2006.01)

(52) U.S. Cl.
CPC ..... *A61H 23/006* (2013.01); *A61H 23/0263* (2013.01); *A61H 2023/002* (2013.01); *A61H 2023/0272* (2013.01); *A61H 2201/0165* (2013.01); *A61H 2201/1215* (2013.01)

(58) Field of Classification Search
CPC ..... A61H 23/00; A61H 23/02; A61H 23/006
See application file for complete search history.

(56) References Cited

U.S. PATENT DOCUMENTS

2020/0261307 A1 * 8/2020 Wersland ..... A61H 1/00

FOREIGN PATENT DOCUMENTS

WO WO-2013153500 A1 * 10/2013 ..... A61H 23/0263
WO WO-2021050861 A1 * 3/2021 ..... A61H 1/00

* cited by examiner

*Primary Examiner* — John P Lacyk

(57) ABSTRACT

A percussive massage device includes an upper half housing, an electric motor, a lower half housing, and a handle. In response to activating the motor, the eccentric counterweight rotates. And in turn, the link converts the rotational motion of the counterweight into a reciprocating linear motion of the follower. The application head strongly moves back and forth to treat body stress or pain of a user.

6 Claims, 3 Drawing Sheets

PERCUSSIVE MASSAGE DEVICE HAVING A USB PORT

BACKGROUND OF THE INVENTION

1. Field of the Invention

The invention relates to percussive massage devices and more particularly to a percussive massage device having a Universal Serial Bus (USB) port.

2. Description of Related Art

Massage is the manipulation of the body's soft tissues. Massage techniques are commonly applied with hands, fingers, or other body parts. The purpose of massage is generally for the treatment of body stress or pain. There are a wide variety of massage devices commercially available because conventional massage techniques are laborious.

However, conventional massage devices provide ineffective massages that are superficial and do not provide any real benefit. Further, conventional massage devices have only one function of massaging. Furthermore, conventional massage devices make a lot of noise in operation due to vibration of the electric motor and in turn components thereof may loosen after a period of time of use. In addition, conventional massage devices are relatively large.

Thus, the need for improvement still exists.

SUMMARY OF THE INVENTION

The invention has been made in an effort to solve the problems of the conventional art including single function, great noise, strong vibration and being relatively large by providing a percussive massage device having novel and nonobvious characteristics.

To achieve above and other objects of the invention, the invention provides a percussive massage device comprising an upper half housing, an electric motor, a lower half housing, and a handle; wherein the motor is disposed in a lower portion of the upper half housing; further comprising a plurality of first screws driven through a flange into a bottom of the electric motor; further comprising a plurality of second screws driven through the flange into the upper half housing; further comprising a third screw driven through an eccentric counterweight into the electric motor; wherein the eccentric counterweight is disposed under the flange; further comprising a plurality of fourth screws driven through a link into the eccentric counterweight; further comprising a first bearing disposed at a left side of the link; further comprising a fifth screw driven through the first bearing into the eccentric counterweight; further comprising a second bearing disposed at a right side of the link; further comprising a follower connected to the right side of the link; further comprising a sixth screw driven through the second bearing into a left side of the follower to join the follower and the link; further comprising a plurality of seventh screws driven through the lower half housing into the upper half housing to fasten them together; further comprising a plurality of rubber sleeves each put on the seventh screw; further comprising a hollow cylinder secured onto a right side of the follower and disposed at right sides of both the upper half housing and the lower half housing; further comprising a rubber pad disposed at a right end of the hollow cylinder; further comprising an applicator head threadedly fastened in the right side of the hollow cylinder; wherein the handle is extended downward from a bottom of the lower half housing; further comprising a plurality of eighth screws driven through the lower half housing into the handle to fasten them together; further comprising a rechargeable battery disposed in the handle; further comprising a USB printed circuit board (PCB) disposed under the battery at a lower portion of the handle; further comprising a USB port disposed at the lower portion of a left side of the handle and connected to the USB PCB by wire; further comprising an ammeter disposed under the USB PCB; further comprising a master PCB disposed under the ammeter; further comprising a rotating shaft disposed in the lower portion of the handle; further comprising a base disposed in the lower portion of the handle; further comprising a plurality of ninth screws driven through the base into the handle to fasten them together; further comprising an on/off switch and a tenth screw driven through the on/off switch into the base to fasten them together; further comprising a rubber cap disposed on the tenth screw; further comprising a DC rubber bar disposed on a bottom of the base; further comprising a speed controller and a speed display both disposed at left sides of the upper half housing and the lower half housing; further comprising a motor switch disposed on the left side of the upper half housing; and wherein the electric motor, the USB PCB, the ammeter, the master PCB, the speed controller, and the speed display are electrically connected to the rechargeable battery.

Preferably, the flange is rectangular and includes four shock absorbing posts at four corners thereof respectively.

Preferably, the shock absorbing posts are formed of rubber.

Preferably, further comprises a plurality of first washers each put on one of the second screws, a second washer put on the fifth screw, and a third washer put on the tenth screw.

Preferably, the rechargeable battery is a 24-volt battery.

Preferably, the link is step-shaped and has a lower left side and a higher right side.

The invention has the following advantageous effects in comparison with the prior art: a user may charge a consumed battery of a mobile phone by inserting a USB plug of the mobile phone into the USB port. The provision of the shock absorbing posts can absorb and damp shock impulses generated by the motor. Thus, components of the percussive massage device are prevented from being loosened. The link is step-shaped and has a lower left side and a higher right side. The link is used to accommodate a distance between the motor and the follower so that the percussive massage device can be made compact.

The above and other objects, features and advantages of the invention will become apparent from the following detailed description taken with the accompanying drawings.

DETAILED DESCRIPTION OF THE INVENTION

Figure 1:
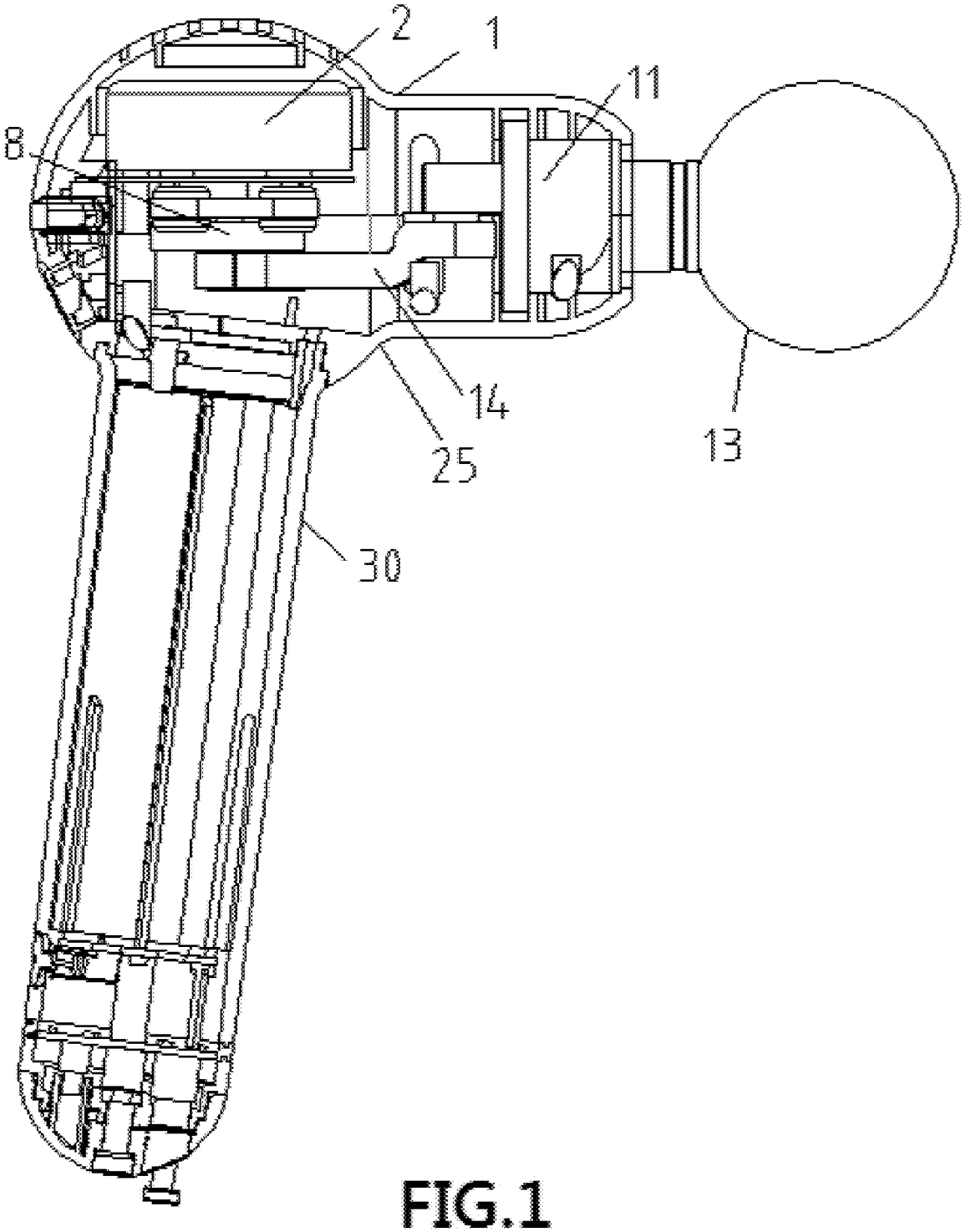
FIG. 1 is a broken away, side elevation view of a percussive massage device according to the invention.
Figure 2:
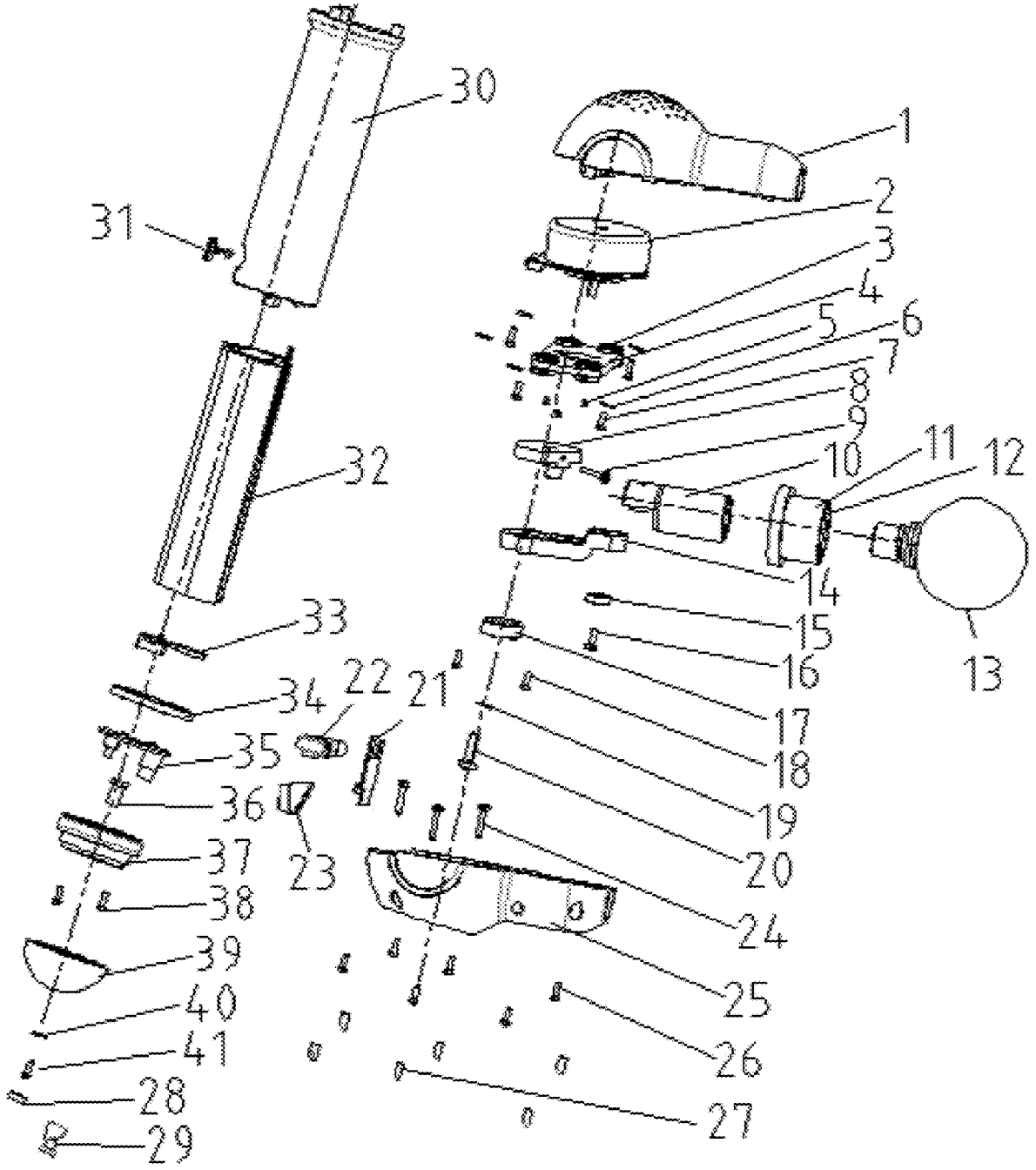
FIG. 2 is an exploded view of the percussive massage device of FIG. 1.
Figure 3:
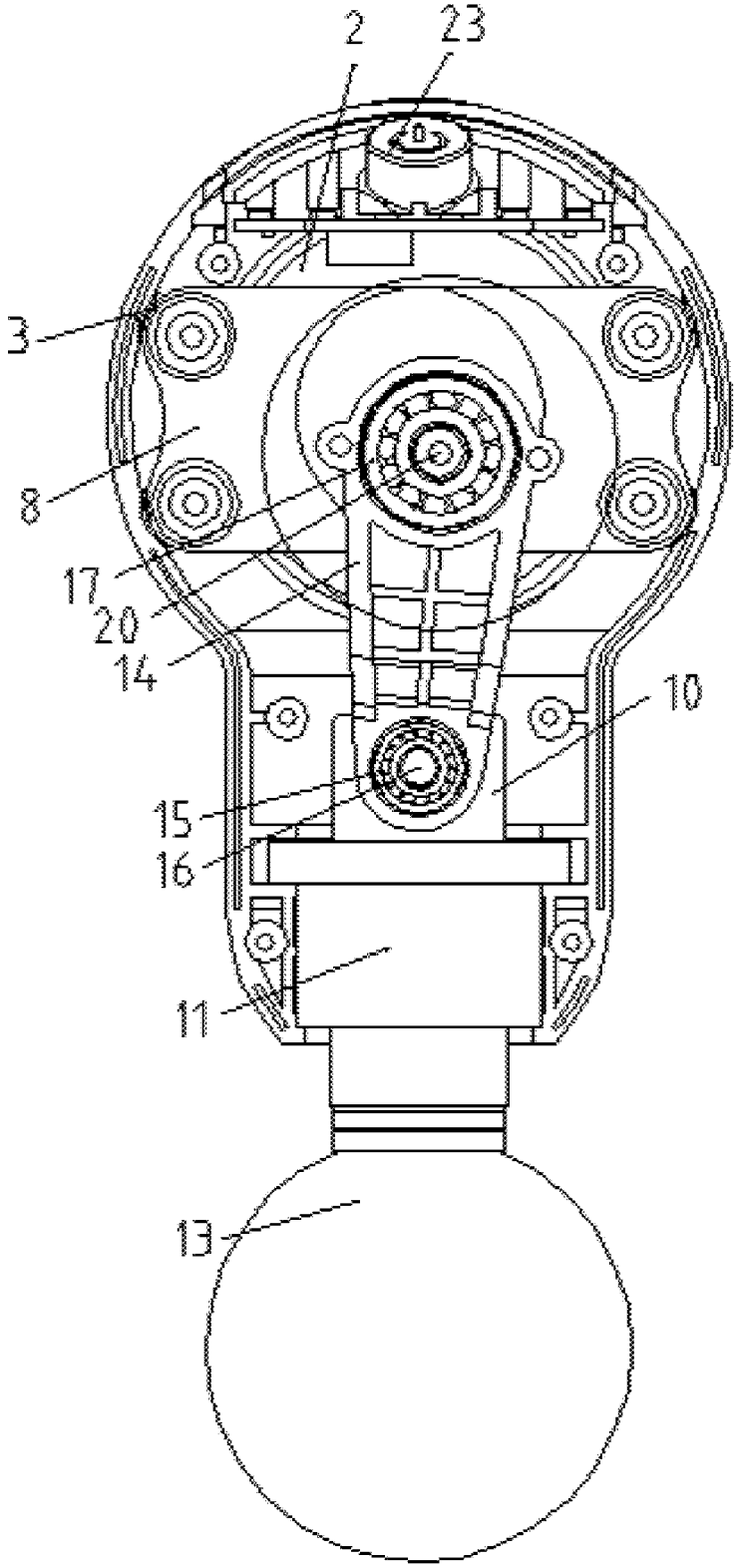
FIG. 3 is a broken away, top view of the percussive massage device.

Referring to FIGS. 1 to 3, a percussive massage device in accordance with the invention comprises an upper half housing 1, an electric motor 2, a lower half housing 25, and a handle 30. The motor 2 is provided in the upper half housing 1. A plurality of screws 5 are driven through a flange 4 into a bottom of the motor 2. A plurality of screws 7 are driven through the flange 4 into the upper half housing 1. A screw 9 is driven through a counterweight 8 into the motor 2. An eccentric member (not shown) is integrally formed with the counterweight 8 to make the counterweight 8 function as an eccentric wheel. The counterweight 8 is below the flange 4. A plurality of screws 18 are driven through a link 14 into the counterweight 8. A first bearing 17 is provided in a hole (not shown) at a left side of the link 14. A screw 5 is driven through the first bearing 17 into the counterweight 8. A screw 20 is used to fasten the first bearing 17. A second bearing 15 is provided in a hole (not shown) at a right side of the link 14. A follower 10 is connected to the right side of the link 14. A screw 16 is driven through the second bearing 15 into a left side of the follower 10 and the link 14. Thus, the follower 10 and the link 14 are joined. A plurality of screws 26 are driven through the lower half housing 25 into the upper half housing 1 to fasten them together. A plurality of rubber sleeves 27 each are put on the screw 26. A hollow cylinder 11 is put on a right side of the follower 10 so that the follower 10 and the hollow cylinder 11 may move as a whole. The hollow cylinder 10 is disposed at right sides of the upper half housing 1 and the lower half housing 25. A rubber pad 12 is provided at a right end of the hollow cylinder 11. An applicator head 13 is threadedly fastened in the right side of the hollow cylinder 11. The handle 30 is extended downward from a bottom of the lower half housing 25. A plurality of screws 24 are driven through the lower half housing 25 into the handle 30 to fasten them together. A rechargeable battery 32 is provided in the handle 30. A Universal Serial Bus (USB) printed circuit board (PCB) 33 is provided below the battery 32 at a lower portion of the handle 30. A USB port 31 is provided at the lower portion of a left side of the handle 30 and connected to the USB PCB 33 by wire. A USB plug can be inserted into the USB port 31 to charge, for example a mobile phone. An ammeter 34 is provided under the USB PCB 33 for measuring the current in the battery 32 and showing same. A master PCB 35 is provided under the ammeter 34. A rotating shaft 36 is provided in the lower portion of the handle 30. A base 37 is provided in the lower portion of the handle 30. A plurality of screws 38 are driven through the base 37 into the handle 30 to fasten them together. A screw 41 is driven through a washer 40 and an on/off switch 39 into the base 37 to fasten them together. The on/off switch 39 can be turned to an off position to stop supplying electricity to the USB port 31 (i.e., the mobile phone being not charged) and the motor 2 (i.e., being deactivated). A rubber cap 28 is mounted on the screw 41. A DC rubber bar 29 is mounted on a bottom of the base 37. A speed controller 21 and a speed display 22 for showing a rotational speed of the motor 2 are provided at left sides of the upper half housing 1 and the lower half housing 25. A motor switch 23 is provided on the left side of the upper half housing 1 for controlling the on and the off of the motor 2. The motor 2, the USB PCB 33, the ammeter 34, the master PCB 35, the speed controller 21, and the speed display 22 are electrically connected to the battery 32.

Four shock absorbing posts 3 are provided at four corners of the rectangular flange 4 for absorbing and damping shock impulses generated by the motor 2. Thus, components of the percussive massage device are prevented from being loosened. The shock absorbing posts 3 are made of rubber and are excellent in absorbing shock.

The screw 7 is driven through each of a plurality of washers 6 and a washer 19 is put on the screw 20. The battery 32 is a 24-volt battery. The shock absorbing posts 3 are provided at four corners of the rectangular flange 4 respectively for absorbing and damping shock impulses generated by the motor 2. Thus, components of the percussive massage device are prevented from being loosened. The shock absorbing posts 3 are made of rubber and are excellent in absorbing shock.

The screw 7 is driven through each of a plurality of washers 6 and a washer 19 is put on the screw 20. The battery 32 is a 24-volt battery. The link 14 is step-shaped and has a lower left side and a higher right side. The link 14 is used to accommodate a distance between the motor 2 and the follower 10 so that the percussive massage device can be made compact.

Operation of the percussive massage device is described below. In response to activating the motor 2, the counterweight 8 rotates. And in turn, the link 14 converts the rotational motion of the counterweight 8 into a reciprocating linear motion of the follower 10. The application head 13 thus strongly moves back and forth to treat body stress or pain of a user.

The invention has the following advantageous effects in comparison with the prior art: a user may charge a consumed battery of a mobile phone by inserting a USB plug of the mobile phone into the USB port 31. The provision of the shock absorbing posts 3 can absorb and damp shock impulses generated by the motor 2. Thus, components of the percussive massage device are prevented from being loosened. The link 14 is step-shaped and has a lower left side and a higher right side. The link 14 is used to accommodate a distance between the motor 2 and the follower 10 so that the percussive massage device can be made compact.

While the invention has been described in terms of preferred embodiments, those skilled in the art will recognize that the invention can be practiced with modifications within the spirit and scope of the appended claims.

What is claimed is:

1. A percussive massage device, comprising an upper half housing, an electric motor, a lower half housing, and a handle;

wherein the motor is disposed in a lower portion of the upper half housing;

further comprising a plurality of first screws driven through a flange into a bottom of the electric motor;

further comprising a plurality of second screws driven through the flange into the upper half housing;

further comprising a third screw driven through an eccentric counterweight into the electric motor;

wherein the eccentric counterweight is disposed under the flange;

further comprising a plurality of fourth screws driven through a link into the eccentric counterweight;

further comprising a first bearing disposed at a left side of the link;

further comprising a fifth screw driven through the first bearing into the eccentric counterweight;

further comprising a second bearing disposed at a right side of the link;

further comprising a follower connected to the right side of the link;

further comprising a sixth screw driven through the second bearing into a left side of the follower to join the follower and the link;

further comprising a plurality of seventh screws driven through the lower half housing into the upper half housing to fasten them together;

further comprising a plurality of rubber sleeves each put on the seventh screw;

further comprising a hollow cylinder secured onto a right side of the follower and disposed at right sides of both the upper half housing and the lower half housing;

further comprising a rubber pad disposed at a right end of the hollow cylinder;

further comprising an applicator head threadedly fastened in the right side of the hollow cylinder;

wherein the handle is extended downward from a bottom of the lower half housing;

further comprising a plurality of eighth screws driven through the lower half housing into the handle to fasten them together;

further comprising a rechargeable battery disposed in the handle;

further comprising a Universal Serial Bus (USB) printed circuit board (PCB) disposed under the battery at a lower portion of the handle;

further comprising a USB port disposed at the lower portion of a left side of the handle and connected to the USB PCB;

further comprising an ammeter disposed under the USB PCB;

further comprising a master PCB disposed under the ammeter;

further comprising a rotating shaft disposed in the lower portion of the handle;

further comprising a base disposed in the lower portion of the handle;

further comprising a plurality of ninth screws driven through the base into the handle to fasten them together;

further comprising an on/off switch and a tenth screw driven through the on/off switch into the base to fasten them together;

further comprising a rubber cap disposed on the tenth screw;

further comprising a DC rubber bar disposed on a bottom of the base;

further comprising a speed controller and a speed display both disposed at left sides of the upper half housing and the lower half housing;

further comprising a motor switch disposed on the left side of the upper half housing; and wherein the electric motor, the USB PCB, the ammeter, the master PCB, the speed controller, and the speed display are electrically connected to the rechargeable battery.

2. The percussive massage device of claim 1, wherein the flange is rectangular and includes four shock absorbing posts at four corners thereof respectively.

3. The percussive massage device of claim 2, wherein the shock absorbing posts are formed of rubber.

4. The percussive massage device of claim 1, further comprising a plurality of first washers each put on one of the second screws, a second washer put on the fifth screw, and a third washer put on the tenth screw.

5. The percussive massage device of claim 1, wherein the rechargeable battery is a 24-volt battery.

6. The percussive massage device of claim 1, wherein the link is step-shaped and has a lower left side and a higher right side.

* * * * *